US012023720B2

(12) United States Patent
Liu et al.

(10) Patent No.: US 12,023,720 B2
(45) Date of Patent: Jul. 2, 2024

(54) METHOD FOR SETTING ROLL GAP OF SINUSOIDAL CORRUGATED ROLLING FOR METAL COMPOSITE PLATE

(71) Applicant: TAIYUAN UNIVERSITY OF TECHNOLOGY, Shanxi (CN)

(72) Inventors: Yuanming Liu, Shanxi (CN); Tao Wang, Shanxi (CN); Pingju Hao, Shanxi (CN); Zhenhua Wang, Shanxi (CN); Dongping He, Shanxi (CN); Zhongkai Ren, Shanxi (CN); Jianchao Han, Shanxi (CN); Qingxue Huang, Shanxi (CN)

(73) Assignee: TAIYUAN UNIVERSITY OF TECHNOLOGY, Shanxi (CN)

( * ) Notice: Subject to any disclaimer, the term of this patent is extended or adjusted under 35 U.S.C. 154(b) by 300 days.

(21) Appl. No.: 17/683,338

(22) Filed: Feb. 28, 2022

(65) Prior Publication Data

US 2022/0184678 A1 Jun. 16, 2022

Related U.S. Application Data

(63) Continuation of application No. PCT/CN2021/079847, filed on Mar. 10, 2021.

(30) Foreign Application Priority Data

Mar. 1, 2021 (CN) ..... 202110227234.X

(51) Int. Cl.
*B21B 1/38* (2006.01)
*B21B 1/08* (2006.01)
(Continued)

(52) U.S. Cl.
CPC ..... *B21B 37/005* (2013.01); *B21B 1/08* (2013.01); *B21B 1/38* (2013.01); *B21B 37/22* (2013.01);
(Continued)

(58) Field of Classification Search
CPC ..... B21B 1/08; B21B 2001/081; B21B 1/227; B21B 1/38; B21B 2001/386;
(Continued)

(56) References Cited

U.S. PATENT DOCUMENTS 11,241,725 B2 * 2/2022 Huang ..... B21H 8/005

OTHER PUBLICATIONS

Mathematical Model of Plates and Strips Rolling for Calculation of Energy Power Parameters and Dynamic loads; Sorochan et al. 2016.*

(Continued)

*Primary Examiner* — Edward T Tolan
(74) *Attorney, Agent, or Firm* — Lei Yu

(57) ABSTRACT

A method for setting a roll gap of sinusoidal corrugated rolling for a metal composite plate includes steps of: determining entrance thicknesses, exit thicknesses, a width, and a rolling temperature of a difficult-to-deform metal slab and an easy-to-deform metal slab; detecting a roll speed and an entrance speed of a metal composite slab, obtaining a roll radius and friction factors; determining parameters of a sinusoidal corrugating roll and a quantity of complete sinusoidal corrugations on the sinusoidal corrugating roll; then calculating a time required for a complete corrugated rolling; calculating a rolling force at any time during the sinusoidal corrugated rolling of the metal composite plate; and calculating the roll gap S of the corrugated rolling at any time according to the rolling force F, and configuring a rolling mill to have the roll gap S according to an actual rolling schedule before normal production.

7 Claims, 3 Drawing Sheets

(51) Int. Cl.

| | |
|---|---|
| ***B21B 37/00*** | (2006.01) |
| ***B21B 37/22*** | (2006.01) |
| ***B21B 37/46*** | (2006.01) |
| ***B21B 37/58*** | (2006.01) |

(52) U.S. Cl.
CPC ..... *B21B 37/46* (2013.01); *B21B 37/58* (2013.01); *B21B 2001/081* (2013.01); *B21B 2001/386* (2013.01); *B21B 2203/38* (2013.01); *B21B 2265/24* (2013.01); *B21B 2267/06* (2013.01); *B21B 2275/04* (2013.01); *B21B 2275/10* (2013.01)

(58) Field of Classification Search
CPC ..... B21B 37/005; B21B 37/16; B21B 37/46; B21B 37/58; B21B 2261/04; B21B 2261/14; B21B 2267/06; B21B 2271/02; B21B 2275/04; B21B 2275/06; B21B 2275/10
See application file for complete search history.

(56) References Cited

OTHER PUBLICATIONS

Dynamic Rolling model based on uniform deformation; Yang et al. Oct. 2020.*
CN 105478475A, Zhu et al. Apr. 2016.*
CN 110252806A, Feng et al. Sep. 2019.*
CN 104841700A, Li et al. Aug. 2015.*
CN 109158433A, Liu et al. Jan. 2019.*

* cited by examiner

METHOD FOR SETTING ROLL GAP OF SINUSOIDAL CORRUGATED ROLLING FOR METAL COMPOSITE PLATE

CROSS REFERENCE OF RELATED APPLICATION

The application is a continuation application of a PCT application No. PCT/CN2021/079847, filed on Mar. 10, 2021; and claims the priority of Chinese Patent Application No. CN202110227234.X, filed to the China National Intellectual Property Administration (CNIPA) on Mar. 1, 2021, the entire content of which are incorporated hereby by reference.

BACKGROUND OF THE PRESENT INVENTION

Field of Invention

The present invention relates to a technical field of rolling, and more particularly to a method for setting a roll gap of sinusoidal corrugated rolling for a metal composite plate.

Description of Related Arts

Metal composite plates can take full advantages of each component material, which improve the overall performance of a single material, greatly enhance strength, corrosion resistance and conductivity of the material, and are widely used in automotive, aerospace, medicine, marine, etc. Conventionally, the processing methods of metal composite plates are mainly cast-rolling method, explosive cladding method, diffusion welding method and roll bonding method, wherein the roll bonding method can provide high production efficiency and can easily realize industrialized mass production.

Conventional flat-roll composite rolling technology has problems that are difficult to solve, such as low bonding interface strength, poor plate shape, and large residual stress. In recent years, a new corrugating roller composite technology (as shown in Chinese patents CN103736728B and CN105478476B) has been proposed. Corrugating roller is applied to difficult-to-deform metals, and flat roller is applied to easy-to-deform metals, which can effectively solve the above problems and improve the bonding strength of metal composite plates, so as to obtain a metal composite plate with excellent performance.

Before plate rolling, adjusting the roll gap of a rolling mill has an important impact on thickness accuracy and shape quality of the plate. Rolling force is the core of the mathematical model of rolling automation control, which directly affects the formulation of the rolling schedule and the adjustment of the roll gap. Conventionally, the rolling force of corrugating is mainly obtained by finite element method, but the calculation time of such method is long. Each calculation can only display the result of a specific process. The calculation speed is slow and the post-processing is complicated, which leads to adjustment problem of the roll gap in the prior art.

SUMMARY OF THE PRESENT INVENTION

To solve the above problem, an object of the present invention is to provide a method for setting a roll gap of sinusoidal corrugated rolling for a metal composite plate.

Accordingly, in order to accomplish the above objects, the present invention provides:

a method for setting a roll gap of sinusoidal corrugated rolling for a metal composite plate, comprising steps of:

step 1: determining entrance thicknesses $h_{1i}$ and $h_{2i}$, exit thicknesses $h_{1f}$ and $h_{2f}$, a width b, and a rolling temperature $T_{temp}$ of a difficult-to-deform metal slab and an easy-to-deform metal slab according to process data of a certain pass;

step 2: detecting a roll speed ω and an entrance speed $v_0$ of a metal composite slab, obtaining a roll radius $R_0$; wherein a friction factor between a corrugating roll and the difficult-to-deform metal slab is $m_1$, and a friction factor between a flat roll and the easy-to-deform metal slab is $m_2$;

step 3: determining parameters of a sinusoidal corrugating roll, wherein an amplitude of the sinusoidal corrugating roll is $A_1$, a quantity of complete sinusoidal corrugations on the sinusoidal corrugating roll is B; then calculating a time T required for a complete corrugated rolling;

step 4: according to functional minimization of a total power in a rolling deformation zone, calculating a rolling force F at any time t during the sinusoidal corrugated rolling of the metal composite plate, which comprises specific steps of:

step 4.1: according to characteristics of the sinusoidal corrugating roll, establishing equations $r_{1\theta}$, $r_{2\theta}$ and $r_{3\theta}$ for describing contact surfaces between the corrugating roll and the difficult-to-deform metal slab, between the flat roll and the easy-to-deform metal slab, and between the difficult-to-deform metal slab and the easy-to-deform metal slab, respectively;

step 4.2: according to natures of a flow function and the characteristics of the sinusoidal corrugating roll, establishing a velocity field and a strain velocity field in a composite slab corrugated rolling deformation zone;

step 4.3: obtaining a slab deformation resistance according to the rolling temperature $T_{temp}$ of the difficult-to-deform metal slab and the easy-to-deform metal slab, an actual material type to be rolled, and a rolling schedule;

step 4.4: according to the velocity field, the strain velocity field, and the slab deformation resistance, calculating a total power functional at any time t of slab corrugated rolling;

step 4.5: calculating a minimum value of the total power functional at any time t, and calculating the rolling force F at any time t according to a relationship between the total power functional and the rolling force; and step 5: calculating the roll gap S of the corrugated rolling at any time t according to the rolling force F, and configuring a rolling mill to have the roll gap S according to an actual rolling schedule before normal production.

Preferably, in the step 3, the time T required for the complete corrugated rolling is calculated as:

$$T = \frac{2\pi}{B\omega}.$$

Preferably, the step 4.1 comprises specific steps of:

establishing a cylindrical coordinate system by defining a center O of a middle portion of the sinusoidal corrugating roll as an origin, and expressing any point in the coordinate system with coordinates (r, θ, z); wherein the contact surface between the corrugating roll and the difficult-to-deform metal slab is expressed as $r_{1\theta}$:

$$r_{1\theta}=R_0+A_1\sin[B(\theta+\omega t])$$

the contact surface between the flat roll and the easy-to-deform metal slab is expressed as $r_{2\theta}$:

$$r_{2\theta}=(2R_0+h_{1f}+h_{2f})\cos\theta-\sqrt{[(2R_0+h_{1f}+h_{2f})\cos\theta]^2-(2R_0+h_{1f}+h_{2f})^2+R_0^2}$$

the contact surface between the difficult-to-deform metal slab and the easy-to-deform metal slab is expressed as $r_{3\theta}$:

$$r_{3\theta}=\frac{2l(R_0+h_{1f})}{2l\cos\theta+(h_{21}-h_{11})\sin\theta}+A_2\sin[B(\theta+\omega t)]$$

wherein l is a horizontal projection length of a roll-slab contact arc during rolling, and an undetermined parameter $A_2$ is a constant which varies with different rolling process parameters; the rolling process parameters comprise metal types, composite slab entrance thicknesses, reductions, entrance speeds, roll speeds and roll radii.

Preferably, the step 4.2 comprises specific steps of:

establishing the velocity field in the rolling deformation zone of the difficult-to-deform metal slab as:

$$v_{1r}=-\frac{1}{r}\frac{\partial\phi_1}{\partial\theta}$$

$$v_{1\theta}=\frac{\partial\phi_1}{\partial r}$$

$$v_{1z}=0$$

wherein $v_{1r}$, $v_{1\theta}$ and $v_{1z}$ are respectively velocity components of the difficult-to-deform metal slab in diameter, circumferential and width directions;

$$\phi_1=v_0h_{1i}b\left[\frac{r-r_{1\theta}}{r_{3\theta}-r_{1\theta}}+\beta_1\theta^2(r-r_{1\theta})(r-r_{3\theta})\right]$$

is the flow function of the difficult-to-deform metal slab, and an undetermined parameter $\beta_1$ is a constant which varies with different rolling process parameters; the rolling process parameters comprise metal types, composite slab entrance thicknesses, reductions, entrance speeds, roll speeds and roll radii;

$$\frac{\partial\phi_1}{\partial\theta}\ \frac{\partial\phi_1}{\partial r}$$

are partial derivatives of $\phi_1$ with respect to θ and r, respectively;

establishing the strain velocity field in the rolling deformation zone of the difficult-to-deform metal slab as:

$$\dot{\varepsilon}_{1r}=\frac{\partial v_{1r}}{\partial r}$$

-continued $$\dot{\varepsilon}_{1\theta}=\frac{1}{r}\frac{\partial v_{1\theta}}{\partial\theta}+\frac{v_{1r}}{r}$$

$$\dot{\varepsilon}_{1z}=\frac{\partial v_{1z}}{\partial z}$$

$$\dot{\varepsilon}_{1r\theta}=\frac{1}{2}\left(\frac{1}{r}\frac{\partial v_{1r}}{\partial\theta}+\frac{\partial v_{1\theta}}{\partial r}-\frac{v_{1\theta}}{r}\right)$$

$$\dot{\varepsilon}_{1\theta z}=\frac{1}{2}\left(\frac{\partial v_{1\theta}}{\partial z}+\frac{1}{r}\frac{\partial v_{1z}}{\partial\theta}\right)$$

$$\dot{\varepsilon}_{1rz}=\frac{1}{2}\left(\frac{\partial v_{1r}}{\partial z}+\frac{\partial v_{1z}}{\partial r}\right)$$

wherein $\dot{\varepsilon}_{1r}$, $\dot{\varepsilon}_{1\theta}$ and $\dot{\varepsilon}_{1z}$ are respectively strain velocity components of the difficult-to-deform metal slab in the diameter, the circumferential and the width directions; $\dot{\varepsilon}_{1r\theta}$ is a shear strain velocity component on circumferential and width sections of the difficult-to-deform metal slab, which points to the circumferential direction; $\dot{\varepsilon}_{1\theta z}$ is a shear strain velocity component on diameter and the width sections of the difficult-to-deform metal slab, which points to the width direction; $\dot{\varepsilon}_{1rz}$ is a shear strain velocity component on the circumferential and the width sections of the difficult-to-deform metal slab, which points to the width direction;

$$\frac{\partial v_{1r}}{\partial r},\ \frac{\partial v_{1\theta}}{\partial r}\ \text{and}\ \frac{\partial v_{1z}}{\partial r}$$

are partial derivatives of $v_{1r}$, $v_{1\theta}$ and $v_{1z}$ with respect to r;

$$\frac{\partial v_{1r}}{\partial\theta},\ \frac{\partial v_{1\theta}}{\partial\theta}\ \text{and}\ \frac{\partial v_{1z}}{\partial\theta}$$

are partial derivatives of $v_{1r}$, $v_{1\theta}$ and $v_{1z}$ with respect to θ;

$$\frac{\partial v_{1r}}{\partial z},\ \frac{\partial v_{1\theta}}{\partial z}\ \text{and}\ \frac{\partial v_{1z}}{\partial z}$$

are partial derivatives of $v_{1r}$, $v_{1\theta}$ and $v_{1z}$ with respect to z; and establishing the velocity field in the rolling deformation zone of the easy-to-deform metal slab as:

$$v_{2r}=-\frac{1}{r}\frac{\partial\phi_2}{\partial\theta}$$

$$v_{2\theta}=\frac{\partial\phi_2}{\partial r}$$

$$v_{2z}=0$$

wherein $v_{2r}$, $v_{2\theta}$, $v_{2z}$ are respectively velocity components of the easy-to-deform metal slab in diameter, circumferential and width directions;

$$\phi_2=v_0h_{1i}b\frac{h_{2f}-A_2\sin(B\omega t)}{h_{1f}+(A_2-A_1)\sin(B\omega t)}\left[\frac{r-r_{3\theta}}{r_{2\theta}-r_{3\theta}}+\beta_2\theta^2(r-r_{2\theta})(r-r_{3\theta})\right]$$

is the flow function of the easy-to-deform metal slab, and an undetermined parameter $\beta_2$ is a constant which varies with the different rolling process parameters; the rolling process parameters comprise the metal types, the composite slab entrance thicknesses, the reductions, the entrance speeds, the roll speeds and the roll radii;

$$\frac{\partial \phi_2}{\partial \theta}, \frac{\partial \phi_2}{\partial r}$$

are partial derivatives of $\phi_2$ with respect to θ and r, respectively;

establishing the strain velocity field in the rolling deformation zone of the easy-to-deform metal slab as:

$$\dot{\varepsilon}_{2r} = \frac{\partial v_{2r}}{\partial r}$$

$$\dot{\varepsilon}_{2\theta} = \frac{1}{r}\frac{\partial v_{2\theta}}{\partial \theta} + \frac{v_{2r}}{r}$$

$$\dot{\varepsilon}_{2z} = \frac{\partial v_{2z}}{\partial z}$$

$$\dot{\varepsilon}_{2r\theta} = \frac{1}{2}\left(\frac{1}{r}\frac{\partial v_{2r}}{\partial \theta} + \frac{\partial v_{2\theta}}{\partial r} - \frac{v_{2\theta}}{r}\right)$$

$$\dot{\varepsilon}_{2\theta z} = \frac{1}{2}\left(\frac{\partial v_{2\theta}}{\partial z} + \frac{1}{r}\frac{\partial v_{2z}}{\partial \theta}\right)$$

$$\dot{\varepsilon}_{2rz} = \frac{1}{2}\left(\frac{\partial v_{2r}}{\partial z} + \frac{\partial v_{2z}}{\partial r}\right)$$

wherein $\dot{\varepsilon}_{2r}$, $\dot{\varepsilon}_{2\theta}$ and $\dot{\varepsilon}_{2z}$ are respectively strain velocity components of the easy-to-deform metal slab in the diameter, the circumferential and the width directions; $\dot{\varepsilon}_{2r\theta}$ is a shear strain velocity component on circumferential and width sections of the easy-to-deform metal slab, which points to the circumferential direction; $\dot{\varepsilon}_{2\theta z}$ is a shear strain velocity component on diameter and the width sections of the easy-to-deform metal slab, which points to the width direction; $\dot{\varepsilon}_{2rz}$ is a shear strain velocity component on the circumferential and the width sections of the easy-to-deform metal slab, which points to the width direction;

$$\frac{\partial v_{2r}}{\partial r}, \frac{\partial v_{2\theta}}{\partial r} \text{ and } \frac{\partial v_{2z}}{\partial r}$$

are partial derivatives of $v_{2r}$, $v_{2\theta}$ and $v_{2z}$ with respect to r;

$$\frac{\partial v_{2r}}{\partial \theta}, \frac{\partial v_{2\theta}}{\partial \theta} \text{ and } \frac{\partial v_{2z}}{\partial \theta}$$

are partial derivatives of $v_{2r}$, $v_{2\theta}$ and $v_{2z}$ with respect to θ;

$$\frac{\partial v_{2r}}{\partial z}, \frac{\partial v_{2\theta}}{\partial z} \text{ and } \frac{\partial v_{2z}}{\partial z}$$

are partial derivatives of $v_{2r}$, $v_{2\theta}$ and $v_{2z}$ with respect to z.

Preferably, in the step 4.4, the total power functional J* at any time t of the slab corrugated rolling is calculated as:

$$J^* = \sqrt{\frac{2}{3}}\sigma_{s1} b \int_0^{\alpha_1}\int_{r_{1\theta}}^{r_{3\theta}} \sqrt{\dot{\varepsilon}_{1r}^2 + \dot{\varepsilon}_{1\theta}^2 + \dot{\varepsilon}_{1z}^2 + 2\dot{\varepsilon}_{1r\theta}^2 + 2\dot{\varepsilon}_{1\theta z}^2 + 2\dot{\varepsilon}_{1rz}^2}\, r dr d\theta +$$

-continued $$\sqrt{\frac{2}{3}}\sigma_{s2} b \int_0^{\alpha_2}\int_{r_{3\theta}}^{r_{2\theta}} \sqrt{\dot{\varepsilon}_{2r}^2 + \dot{\varepsilon}_{2\theta}^2 + \dot{\varepsilon}_{2z}^2 + 2\dot{\varepsilon}_{2r\theta}^2 + 2\dot{\varepsilon}_{2\theta z}^2 + 2\dot{\varepsilon}_{2rz}^2}\, r dr d\theta +$$

$$\frac{\sigma_{s1} b}{\sqrt{3}}\int_{r_{1\theta}}^{r_{3\theta}|_{\theta=\alpha_1}} \sqrt{(v_{1\theta}|_{\theta=\alpha_1})^2 + (v_{1r}|_{\theta=\alpha_1})^2}\, r dr +$$

$$\frac{\sigma_{s2} b}{\sqrt{3}}\int_{r_{3\theta}|_{\theta=\alpha_2}}^{r_{2\theta}} \sqrt{(v_{2\theta}|_{\theta=\alpha_2})^2 + (v_{2r}|_{\theta=\alpha_2})^2}\, r dr +$$

$$\frac{m_1 \sigma_{s1} b}{\sqrt{3}}\int_0^{\alpha_1} \sqrt{(v_{1\theta}|_{r=r_{1\theta}} - r_{1\theta}\omega)^2}\, r_{1\theta} d\theta +$$

$$\frac{m_2 \sigma_{s2} b}{\sqrt{3}}\int_0^{\alpha_2} \sqrt{(v_{2\theta}|_{r=r_{2\theta}} - R_0\omega)^2}\, r_{2\theta} d\theta$$

wherein $\sigma_{s1}$ and $\sigma_{s2}$ are the deformation resistances of the difficult-to-deform metal slab and the easy-to-deform metal slab, $$\alpha_1 = \arcsin\left(\frac{l}{R_0}\right)$$

is an angle between MO and a roll center line $OO_2$, M is a contact point between the difficult-to-deform metal slab and the corrugating roll, $$\alpha_2 = \arctan\left(\frac{2l}{2R_0 + h_{1i} + h_{2i} + h_{1f} + h_{2f}}\right)$$

is an angle between NO and the roll center line $OO_2$, N is a contact point between the easy-to-deform metal slab and the flat roll.

Preferably, the step 4.5 comprises specific steps of: calculating the minimum value $J_{min}$* of the total power functional at any time t, and calculating the rolling force F at any time t according to the relationship $$F = \frac{J_{min}^*}{2\omega\chi\sqrt{2R_0(h_{1i} + h_{2i} - h_{1f} - h_{2f})}}$$

between the total power functional and the rolling force, wherein χ is a force arm coefficient.

Preferably, in the step 5, the roll gap S is calculated as:

$$S = h_{1f} + h_{2f} - \frac{F}{M}$$

wherein M is a stiffness of the rolling mill.

Compared with the prior art, the present invention has the following advantages.

The present invention predicts the rolling force during the corrugated rolling process, and a real-time predicted rolling force is closer to an actual value. The present invention accurately predicts the rolling force during the corrugated rolling process on the basis of comprehensively considering various process parameters in the rolling process, which solves a problem of real-time rolling force prediction under different production conditions. The present invention is safe and reliable, and provides accurate calculations, which can calculate the rolling force during continuous rolling process in real-time. The present invention can be applied to rolling force configuration of corrugating composite processes of different metals such as copper/aluminum, magnesium/aluminum, titanium/stainless and steel, titanium/aluminum, so as to adjust the roll gap of the rolling mill in rolling production, which improves accuracy of product thickness control.

DETAILED DESCRIPTION OF THE PREFERRED EMBODIMENT

To further illustrate technical solutions, the present invention will be illustrated below with the following embodiment.

Figure 1:
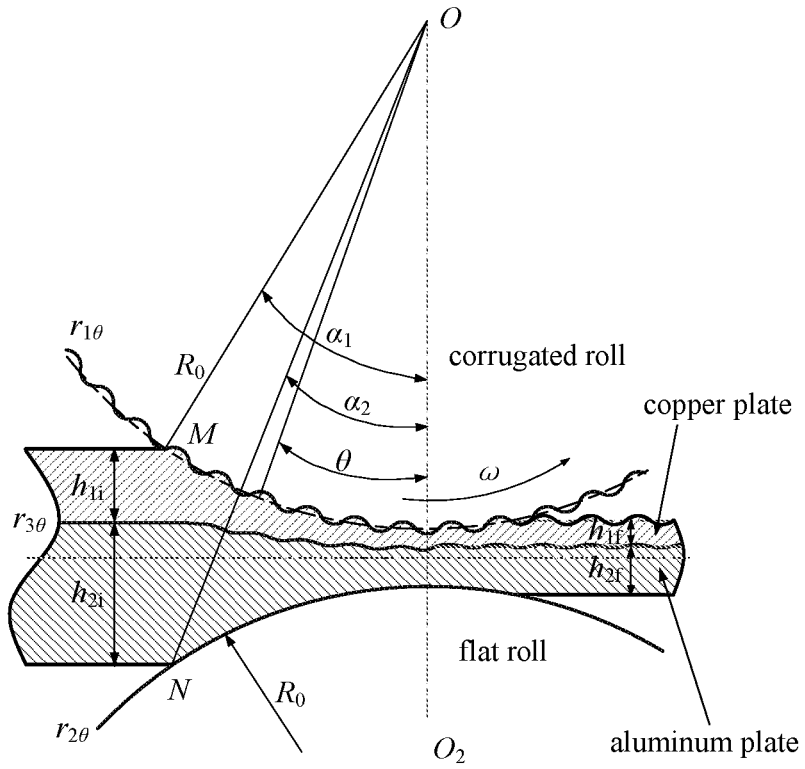
FIG. 1 is a sketch view of deformation zone for a metal composite plate in corrugated rolling by sinusoidal roller according to an embodiment of the present invention.

According to the embodiment, a sinusoidal corrugated rolling process of a copper plate and an aluminum plate is taken as an example, and a rolling deformation zone is shown in FIG. 1.

Figure 2:
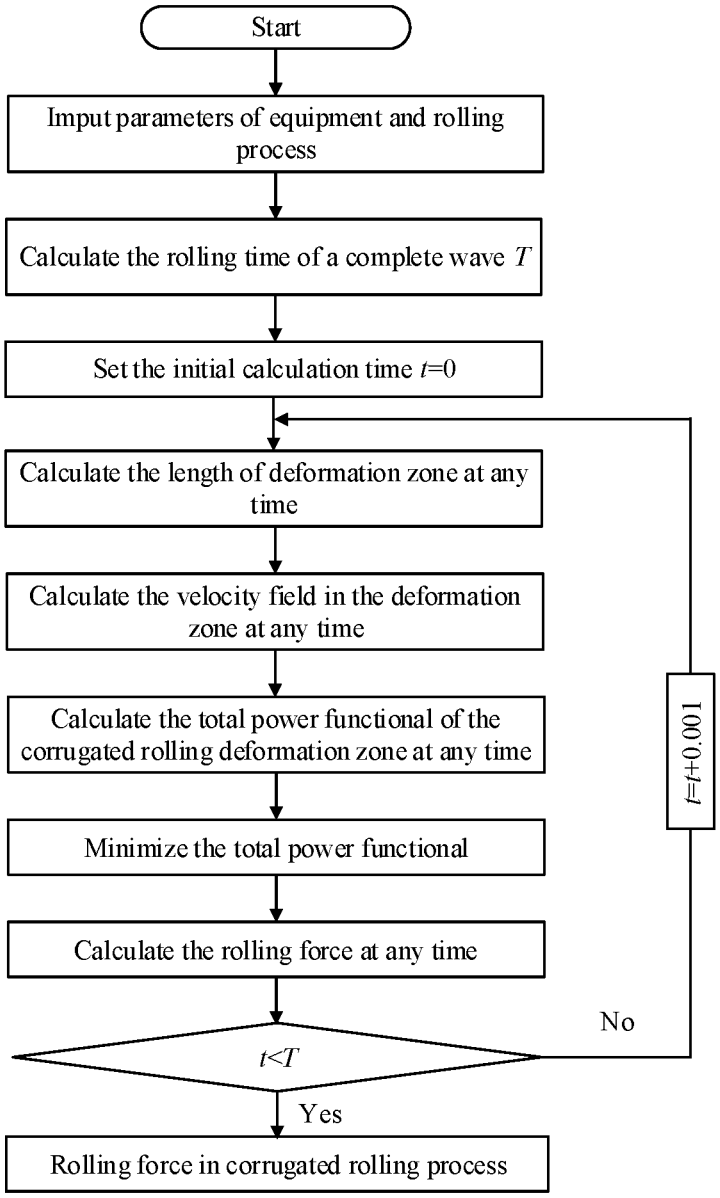
FIG. 2 is a flow chart of calculating a rolling force for a metal composite plate in corrugated rolling by sinusoidal roller according to the embodiment of the present invention.

According to the embodiment, a method for setting a roll gap of sinusoidal corrugated rolling for a metal composite plate, as shown in FIG. 2, comprises steps of:

step 1: determining entrance thicknesses $h_{1i}$=2 mm and $h_{2i}$=8 mm, exit thicknesses $h_{1f}$=1 mm and $h_{2f}$=3.8 mm, a width b=200 mm, and a rolling temperature at a room temperature of a copper plate and an aluminum plate according to process schedule;

step 2: detecting upper and lower roll speeds ω=1.3 rad/s and an entrance speed $v_0$=0.2 m/s of a metal composite slab, obtaining a roll radius $R_0$=160 mm; wherein a friction factor between a corrugating roll and the copper plate is $m_1$=0.28, and a friction factor between a flat roll and the aluminum plate is $m_2$=0.38;

step 3: determining parameters of a sinusoidal corrugating roll, wherein an amplitude of the sinusoidal corrugating roll is $A_1$=0.8 mm, a quantity of complete sinusoidal corrugations on the sinusoidal corrugating roll is B=75; then calculating a time $$T = \frac{2\pi}{B\omega} = \frac{2\pi}{75\times 1.3} = 0.032\ s$$

required for a complete corrugated rolling;

step 4: according to functional minimization of a total power in a rolling deformation zone, calculating a rolling force F at any time t during the sinusoidal corrugated rolling of the metal composite plate, which comprises specific steps of:

step 4.1: according to characteristics of the sinusoidal corrugating roll, establishing equations $r_{1\theta}$, $r_{2\theta}$ and $r_{3\theta}$ for describing contact surfaces between the corrugating roll and the copper plate, between the flat roll and the aluminum plate, and between the cooper plate and the aluminum plate, respectively;

establishing a cylindrical coordinate system by defining a center O of a middle portion of the sinusoidal corrugating roll as an origin, and expressing any point in the coordinate system with coordinates (r, θ, z); wherein the contact surface between the corrugating roll and the copper plate is expressed as $r_{1\theta}$:

$$r_{1\theta}=R_0+A_1\sin[B(\theta+\omega t)]$$

the contact surface between the flat roll and the aluminum plate is expressed as $r_{2\theta}$:

$$r_{2\theta}=(2R_0+h_{1f}+h_{2f})\cos\theta-\sqrt{[(2R_0+h_{1f}+h_{2f})\cos\theta]^2-(2R_0+h_{1f}+h_{2f})^2+R_0^2}$$

the contact surface between the cooper plate and the aluminum plate is expressed as $r_{3\theta}$:

$$r_{3\theta} = \frac{2l(R_0 + h_{1f})}{2l\cos\theta + (h_{2i} - h_{1i})\sin\theta} + A_2\sin[B(\theta + \omega t)]$$

wherein l is a horizontal projection length of a roll-slab contact arc during rolling, and an undetermined parameter $A_2$ is a constant which varies with different rolling process parameters; the rolling process parameters comprise metal types, composite slab entrance thicknesses, reductions, entrance speeds, roll speeds and roll radii;

step 4.2: according to natures of a flow function and the characteristics of the sinusoidal corrugating roll, establishing a velocity field and a strain velocity field in a composite slab corrugated rolling deformation zone;

establishing the velocity field in the rolling deformation zone of the copper plate as:

$$v_{1r} = -\frac{1}{r}\frac{\partial\phi_1}{\partial\theta}$$

$$v_{1\theta} = \frac{\partial\phi_1}{\partial r}$$

$$v_{1z} = 0$$

wherein $v_{1r}$, $v_{1\theta}$ and $v_{1z}$ are respectively velocity components of the copper plate in diameter, circumferential and width directions;

$$\phi_1 = v_0 h_{1i} b\left[\frac{r - r_{1\theta}}{r_{3\theta} - r_{1\theta}} + \beta_1\theta^2(r - r_{1\theta})(r - r_{3\theta})\right]$$

is the flow function of the copper plate, and an undetermined parameter $\beta_1$ is a constant which varies with different rolling process parameters; the rolling process parameters comprise metal types, composite slab entrance thicknesses, reductions, entrance speeds, roll speeds and roll radii;

$$\frac{\partial\phi_1}{\partial\theta},\ \frac{\partial\phi_1}{\partial r}$$

are partial derivatives of $\phi_1$ with respect to θ and r, respectively;

establishing the strain velocity field in the rolling deformation zone of the copper plate as:

$$\dot{\varepsilon}_{1r} = \frac{\partial v_{1r}}{\partial r}$$

$$\dot{\varepsilon}_{1\theta} = \frac{1}{r}\frac{\partial v_{1\theta}}{\partial \theta} + \frac{v_{1r}}{r}$$

$$\dot{\varepsilon}_{1z} = \frac{\partial v_{1z}}{\partial z}$$

$$\dot{\varepsilon}_{1r\theta} = \frac{1}{2}\left(\frac{1}{r}\frac{\partial v_{1r}}{\partial \theta} + \frac{\partial v_{1\theta}}{\partial r} - \frac{v_{1\theta}}{r}\right)$$

$$\dot{\varepsilon}_{1\theta z} = \frac{1}{2}\left(\frac{\partial v_{1\theta}}{\partial z} + \frac{1}{r}\frac{\partial v_{1z}}{\partial \theta}\right)$$

$$\dot{\varepsilon}_{1rz} = \frac{1}{2}\left(\frac{\partial v_{1r}}{\partial z} + \frac{\partial v_{1z}}{\partial r}\right)$$

wherein $\dot{\varepsilon}_{1r}$, $\dot{\varepsilon}_{1\theta}$ and $\dot{\varepsilon}_{1z}$ are respectively strain velocity components of the copper plate in the diameter, the circumferential and the width directions; $\dot{\varepsilon}_{1r\theta}$ is a shear strain velocity component on circumferential and width sections of the copper plate, which points to the circumferential direction; $\dot{\varepsilon}_{1\theta z}$ is a shear strain velocity component on diameter and the width sections of the copper plate, which points to the width direction; $\dot{\varepsilon}_{1rz}$ is a shear strain velocity component on the circumferential and the width sections of the copper plate, which points to the width direction;

$$\frac{\partial v_{1r}}{\partial r}, \frac{\partial v_{1\theta}}{\partial r} \text{ and } \frac{\partial v_{1z}}{\partial r}$$

are partial derivatives of $v_{1r}$, $v_{1\theta}$ and $v_{1z}$ with respect to r;

$$\frac{\partial v_{1r}}{\partial \theta}, \frac{\partial v_{1\theta}}{\partial \theta} \text{ and } \frac{\partial v_{1z}}{\partial \theta}$$

are partial derivatives of $v_{1r}$, $v_{1\theta}$ and $v_{1z}$ with respect to θ;

$$\frac{\partial v_{1r}}{\partial z}, \frac{\partial v_{1\theta}}{\partial z} \text{ and } \frac{\partial v_{1z}}{\partial z}$$

are partial derivatives of $v_{1r}$, $v_{1\theta}$ and $v_{1z}$ with respect to z;

establishing the velocity field in the rolling deformation zone of the aluminum plate as:

$$v_{2r} = -\frac{1}{r}\frac{\partial \phi_2}{\partial \theta}$$

$$v_{2\theta} = \frac{\partial \phi_2}{\partial r}$$

$$v_{2z} = 0$$

wherein $v_{2r}$, $v_{2\theta}$, $v_{2z}$ are respectively velocity components of the aluminum plate in diameter, circumferential and width directions;

$$\phi_2 = v_0 h_{1i} b \frac{h_{2f} - A_2 \sin(B\omega t)}{h_{1f} + (A_2 - A_1)\sin(B\omega t)}\left[\frac{r - r_{3\theta}}{r_{2\theta} - r_{3\theta}} + \beta_2\theta^2(r - r_{2\theta})(r - r_{3\theta})\right]$$

is the flow function of the aluminum plate, and an undetermined parameter $\beta_2$ is a constant which varies with the different rolling process parameters; the rolling process parameters comprise the metal types, the composite slab entrance thicknesses, the reductions, the entrance speeds, the roll speeds and the roll radii;

$$\frac{\partial \phi_2}{\partial \theta}, \frac{\partial \phi_2}{\partial r}$$

are partial derivatives of $\phi_2$ with respect to θ and r, respectively;

establishing the strain velocity field in the rolling deformation zone of the aluminum plate as:

$$\dot{\varepsilon}_{2r} = \frac{\partial v_{2r}}{\partial r}$$

$$\dot{\varepsilon}_{2\theta} = \frac{1}{r}\frac{\partial v_{2\theta}}{\partial \theta} + \frac{v_{2r}}{r}$$

$$\dot{\varepsilon}_{2z} = \frac{\partial v_{2z}}{\partial z}$$

$$\dot{\varepsilon}_{2r\theta} = \frac{1}{2}\left(\frac{1}{r}\frac{\partial v_{2r}}{\partial \theta} + \frac{\partial v_{2\theta}}{\partial r} - \frac{v_{2\theta}}{r}\right)$$

$$\dot{\varepsilon}_{2\theta z} = \frac{1}{2}\left(\frac{\partial v_{2\theta}}{\partial z} + \frac{1}{r}\frac{\partial v_{2z}}{\partial \theta}\right)$$

$$\dot{\varepsilon}_{2rz} = \frac{1}{2}\left(\frac{\partial v_{2r}}{\partial z} + \frac{\partial v_{2z}}{\partial r}\right)$$

wherein $\dot{\varepsilon}_{2r}$, $\dot{\varepsilon}_{2\theta}$ and $\dot{\varepsilon}_{2z}$ are respectively strain velocity components of the aluminum plate in the diameter, the circumferential and the width directions; $\dot{\varepsilon}_{2r\theta}$ is a shear strain velocity component on circumferential and width sections of the aluminum plate, which points to the circumferential direction; $\dot{\varepsilon}_{2\theta z}$ is a shear strain velocity component on diameter and the width sections of the aluminum plate, which points to the width direction; $\dot{\varepsilon}_{2rz}$ is a shear strain velocity component on the circumferential and the width sections of the aluminum plate, which points to the width direction;

$$\frac{\partial v_{2r}}{\partial r}, \frac{\partial v_{2\theta}}{\partial r} \text{ and } \frac{\partial v_{2z}}{\partial r}$$

are partial derivatives of $v_{2r}$, $v_{2\theta}$ and $v_{2z}$ with respect to r;

$$\frac{\partial v_{2r}}{\partial \theta}, \frac{\partial v_{2\theta}}{\partial \theta} \text{ and } \frac{\partial v_{2z}}{\partial \theta}$$

are partial derivatives of $v_{2r}$, $v_{2\theta}$ and $v_{2z}$ with respect to θ;

$$\frac{\partial v_{2r}}{\partial z}, \frac{\partial v_{2\theta}}{\partial z} \text{ and } \frac{\partial v_{2z}}{\partial z}$$

are partial derivatives of $v_{2r}$, $v_{2\theta}$ and $v_{2z}$ with respect to z;

step 4.3: according to a rolling schedule, obtaining a deformation resistance of the copper plate: $\sigma_{s1}=335.2\varepsilon_1^{0.113}$ (MPa), and obtaining a deformation resistance of the aluminum plate: $\sigma_{s2}=189.2\varepsilon_2^{0.239}$ (MPa);

wherein $$\varepsilon_1 = \frac{h_{1i} - h_{1f}}{h_{1i}} \varepsilon_2 = \frac{h_{2i} - h_{2f}}{h_{2i}}$$

are reductions of the copper plate and the aluminum plate, respectively;

step 4.4: according to the velocity field, the strain velocity field, and the slab deformation resistance, calculating a total power functional J* at any time t of slab corrugated rolling:

$$J^* = \sqrt{\frac{2}{3}}\sigma_{s1} b \int_0^{\alpha_1} \int_{r_{1\theta}}^{r_{3\theta}} \sqrt{\dot{\varepsilon}_{1r}^2 + \dot{\varepsilon}_{1\theta}^2 + \dot{\varepsilon}_{1z}^2 + 2\dot{\varepsilon}_{1r\theta}^2 + 2\dot{\varepsilon}_{1\theta z}^2 + 2\dot{\varepsilon}_{1rz}^2}\, r dr d\theta + \sqrt{\frac{2}{3}}\sigma_{s2} b \int_0^{\alpha_2} \int_{r_{3\theta}}^{r_{2\theta}} \sqrt{\dot{\varepsilon}_{2r}^2 + \dot{\varepsilon}_{2\theta}^2 + \dot{\varepsilon}_{2z}^2 + 2\dot{\varepsilon}_{2r\theta}^2 + 2\dot{\varepsilon}_{2\theta z}^2 + 2\dot{\varepsilon}_{2rz}^2}\, r dr d\theta + \frac{\sigma_{s1} b}{\sqrt{3}} \int_{r_{1\theta}}^{r_{3\theta}|_{\theta=\alpha_1}} \sqrt{(v_{1\theta}|_{\theta=\alpha_1})^2 + (v_{1r}|_{\theta=\alpha_1})^2}\, r dr + \frac{\sigma_{s2} b}{\sqrt{3}} \int_{r_{3\theta}|_{\theta=\alpha_2}}^{r_{2\theta}} \sqrt{(v_{2\theta}|_{\theta=\alpha_2})^2 + (v_{2r}|_{\theta=\alpha_2})^2}\, r dr + \frac{m_1 \sigma_{s1} b}{\sqrt{3}} \int_0^{\alpha_1} \sqrt{(v_{1\theta}|_{r=r_{1\theta}} - r_{1\theta}\omega)^2}\, r_{1\theta} d\theta + \frac{m_2 \sigma_{s2} b}{\sqrt{3}} \int_0^{\alpha_2} \sqrt{(v_{2\theta}|_{r=r_{2\theta}} - R_0\omega)^2}\, r_{2\theta} d\theta$$

wherein $$\alpha_1 = \arcsin\left(\frac{l}{R_0}\right)$$

is an angle between MO and a roll center line $OO_2$, M is a contact point between the copper plate and the corrugating roll, $$a_2 = \arctan\left(\frac{2l}{2R_0 + h_{1i} + h_{2i} + h_{1f} + h_{2f}}\right)$$

is an angle between NO and the roll center line $OO_2$, N is a contact point between the aluminum plate and the flat roll;

step 4.5: calculating the minimum value $J_{min}$* of the total power functional at any time t, and calculating the rolling force F at any time t according to the relationship $$F = \frac{J_{min}^*}{2\omega\chi\sqrt{2R_0(h_{1i} + h_{2i} - h_{1f} - h_{2f})}}$$

between the total power functional and the rolling force; and step 5: calculating the roll gap S of the corrugated rolling at any time t according to the rolling force F, and configuring a rolling mill to have the roll gap S according to an actual rolling schedule before normal production;

wherein the roll gap S is calculated as:

$$S = h_{1f} + h_{2f} - \frac{F}{M}$$

wherein M is a stiffness of the rolling mill.

Figure 3:
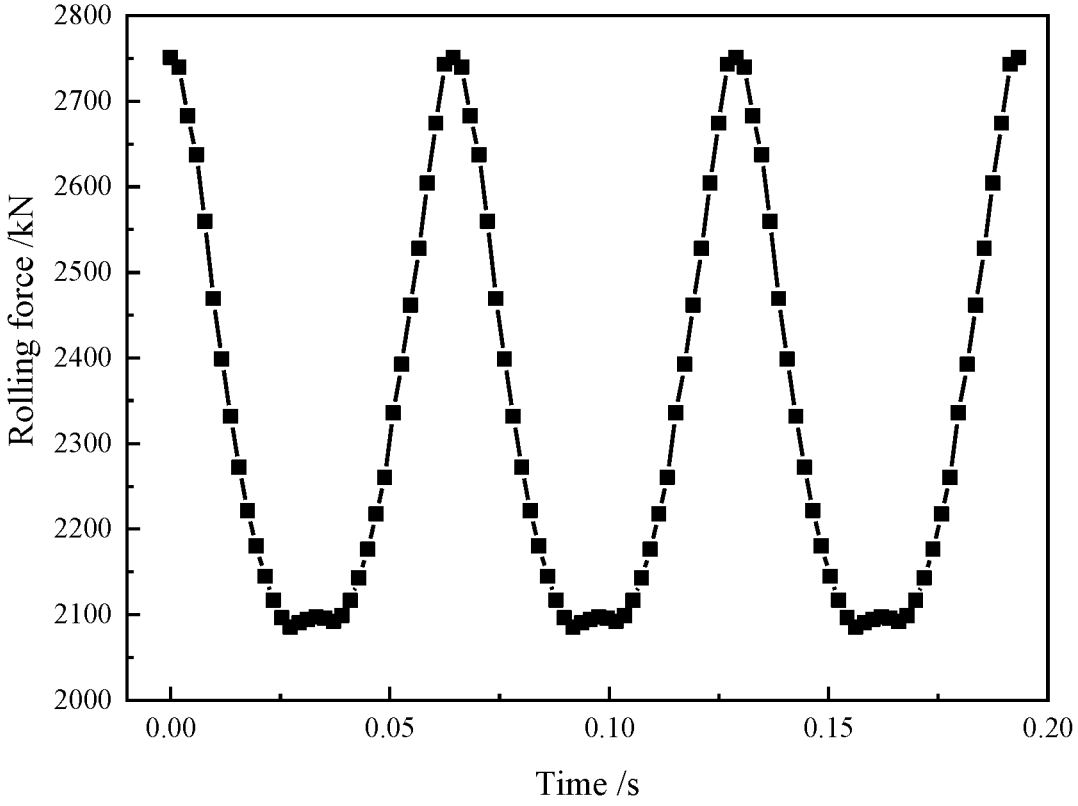
FIG. 3 illustrates predicted values of rolling force varied with time for a metal composite plate in corrugated rolling by sinusoidal roller according to the embodiment of the present invention.

FIG. 3 illustrates predicted values of the time-related rolling force of the sinusoidal corrugated rolling for the cooper-aluminum composite plate according to the embodiment of the present invention.

In the present invention, the roll radius=a nominal radius of the corrugating roll=a radius of the flat roll.

In addition, when a hot rolling method is used to produce the composite plate, it is only necessary to calculate the deformation resistance of the slab in the step 4.3 according to a slab rolling temperature $T_{temp}$, a material type to be rolled, and the rolling schedule. For example, when rolling a Q235 steel/304 stainless steel composite plate, according to the rolling schedule, the deformation resistance of Q235 steel is:

$$\sigma_s = 150 e^{\left(-2.8685\frac{T_{temp}+273}{1000} - 3.6573\right)} \left(\frac{\dot{\varepsilon}_{Q235}}{10}\right)^{\left(0.2121\frac{T_{temp}+273}{1000} + 0.1531\right)} \left[1.4403\left(\frac{\varepsilon_{Q235}}{0.4}\right)^{0.3912} - 0.4403\frac{\varepsilon_{Q235}}{0.4}\right] \text{MPa};$$

the deformation resistance of 304 stainless steel is:

$$\sigma_s = 175 e^{\left(-2.291\frac{T_{temp}+273}{1000} + 2.846\right)} \left(\frac{\dot{\varepsilon}_{304}}{10}\right)^{\left(-0.3526\frac{T_{temp}+273}{1000} - 0.3865\right)} \left[1.3536\left(\frac{\varepsilon_{304}}{0.4}\right)^{0.3488} - 0.3536\frac{\varepsilon_{304}}{0.4}\right] \text{MPa};$$

$\varepsilon_{Q235}$ is the reduction of the Q235 steel; $\dot{\varepsilon}_{Q235}$ is a strain velocity of the Q235 steel; $\varepsilon_{304}$ is the reduction of the 304 stainless steel; and $\dot{\varepsilon}_{304}$ is the strain velocity of the 304 stainless steel.

The main features and advantages of the present invention are shown and described above. For those skilled in the art, it is clear that the present invention is not limited to the details of the above embodiment, and can be implemented in other forms without departing from the spirit or basic characteristics of the present invention. Therefore, from any point of view, the embodiment should be regarded as exemplary and non-limiting. The scope of the present invention is defined by the appended claims rather than the foregoing description. Therefore, all changes falling within the meaning and scope of equivalent elements of the claims are intended to be included in the present invention.

In addition, it should be understood that although this specification is described in accordance with the embodiment, it doesn't mean that each embodiment only contains one independent technical solution. The description in the specification is only for the sake of clarity, and those skilled in the art should regard the specification as a whole, which means the technical solutions in the embodiment can also be appropriately combined to form other embodiments that can be understood by those skilled in the art.

What is claimed is:

1. A method for setting a roll gap of sinusoidal corrugated rolling for a metal composite plate, comprising steps of:

step 1: determining entrance thicknesses $h_{1i}$, and $h_{2i}$, exit thicknesses $h_{1f}$ and $h_{2f}$, a width b, and a rolling temperature $T_{temp}$ of a difficult-to-deform metal slab and an easy-to-deform metal slab according to process data of a certain pass;

step 2: detecting a roll speed ω and an entrance speed $v_0$ of a metal composite slab, obtaining a roll radius $R_0$; wherein a friction factor between a corrugating roll and the difficult-to-deform metal slab is $m_1$, and a friction factor between a flat roll and the easy-to-deform metal slab is $m_2$;

step 3: determining parameters of a sinusoidal corrugating roll, wherein an amplitude of the sinusoidal corrugating roll is $A_1$, a quantity of complete sinusoidal corrugations on the sinusoidal corrugating roll is B; then calculating a time T required for a complete corrugated rolling;

step 4: according to functional minimization of a total power in a rolling deformation zone, calculating a rolling force F at any time t during the sinusoidal corrugated rolling of the metal composite plate, which comprises specific steps of:

step 4.1: according to characteristics of the sinusoidal corrugating roll, establishing equations $r_{1\theta}$, $r_{2\theta}$ and $r_{3\theta}$ for describing contact surfaces between the corrugating roll and the difficult-to-deform metal slab, between the flat roll and the easy-to-deform metal slab, and between the difficult-to-deform metal slab and the easy-to-deform metal slab, respectively;

step 4.2: according to natures of a flow function and the characteristics of the sinusoidal corrugating roll, establishing a velocity field and a strain velocity field in a composite slab corrugated rolling deformation zone;

step 4.3: obtaining a slab deformation resistance according to the rolling temperature $T_{temp}$ of the difficult-to-deform metal slab and the easy-to-deform metal slab, an actual material type to be rolled, and a rolling schedule;

step 4.4: according to the velocity field, the strain velocity field, and the slab deformation resistance, calculating a total power functional at any time t of slab corrugated rolling;

step 4.5: calculating a minimum value of the total power functional at any time t, and calculating the rolling force F at any time t according to a relationship between the total power functional and the rolling force; and step 5: calculating the roll gap S of the corrugated rolling at any time t according to the rolling force F, and configuring a rolling mill to have the roll gap S according to an actual rolling schedule before normal production.

2. The method, as recited in claim 1, wherein in the step 3, the time T required for the complete corrugated rolling is calculated as:

$$T = \frac{2\pi}{B\omega}.$$

3. The method, as recited in claim 1, wherein the step 4.1 comprises specific steps of:

establishing a cylindrical coordinate system by defining a center O of a middle portion of the sinusoidal corrugating roll as an origin, and expressing any point in the coordinate system with coordinates (r, θ, z); wherein the contact surface between the corrugating roll and the difficult-to-deform metal slab is expressed as $r_{1\theta}$:

$$r_{1\theta}=R_0+A_1\sin[B(\theta+\omega t)]$$

the contact surface between the flat roll and the easy-to-deform metal slab is expressed as $r_{2\theta}$:

$$r_{2\theta}=(2R_0+h_{1f}+h_{2f})\cos\theta-\sqrt{[(2R_0+h_{1f}+h_{2f})\cos\theta]^2-(2R_0+h_{1f}+h_{2f})^2+R_0^2}$$

the contact surface between the difficult-to-deform metal slab and the easy-to-deform metal slab is expressed as $r_{3\theta}$:

$$r_{3\theta} = \frac{2l(R_0 + h_{1f})}{2l\cos\theta + (h_{2i} - h_{1i})\sin\theta} + A_2\sin[B(\theta + \omega t)]$$

wherein l is a horizontal projection length of a roll-slab contact arc during rolling, and an undetermined parameter $A_2$ is a constant which varies with different rolling process parameters; the rolling process parameters comprise metal types, composite slab entrance thicknesses, reductions, entrance speeds, roll speeds and roll radii.

4. The method, as recited in claim 1, wherein the step 4.2 comprises specific steps of:

establishing the velocity field in the rolling deformation zone of the difficult-to-deform metal slab as:

$$v_{1r} = -\frac{1}{r}\frac{\partial\phi_1}{\partial\theta}$$

$$v_{1\theta} = \frac{\partial\phi_1}{\partial r}$$

$$v_{1z} = 0$$

wherein $v_{1r}$, $v_{1\theta}$ and $v_{1z}$ are respectively velocity components of the difficult-to-deform metal slab in diameter, circumferential and width directions;

$$\phi_1 = v_0 h_{1i} b\left[\frac{r - r_{1\theta}}{r_{3\theta} - r_{1\theta}} + \beta_1\theta^2(r - r_{1\theta})(r - r_{3\theta})\right]$$

is the flow function of the difficult-to-deform metal slab, and an undetermined parameter $\beta_1$ is a constant which varies with different rolling process parameters; the rolling process parameters comprise metal types, composite slab entrance thicknesses, reductions, entrance speeds, roll speeds and roll radii;

$$\frac{\partial\phi_1}{\partial\theta}, \frac{\partial\phi_1}{\partial r}$$

are partial derivatives of $\phi_1$ with respect to θ and r, respectively;

establishing the strain velocity field in the rolling deformation zone of the difficult-to-deform metal slab as:

$$\dot{\varepsilon}_{1r} = \frac{\partial v_{1r}}{\partial r}$$

-continued $$\dot{\varepsilon}_{1\theta} = \frac{1}{r}\frac{\partial v_{1\theta}}{\partial \theta} + \frac{v_{1r}}{r}$$

$$\dot{\varepsilon}_{1z} = \frac{\partial v_{1z}}{\partial z}$$

$$\dot{\varepsilon}_{1r\theta} = \frac{1}{2}\left(\frac{1}{r}\frac{\partial v_{1r}}{\partial \theta} + \frac{\partial v_{1\theta}}{\partial r} - \frac{v_{1\theta}}{r}\right)$$

$$\dot{\varepsilon}_{1\theta z} = \frac{1}{2}\left(\frac{\partial v_{1\theta}}{\partial z} + \frac{1}{r}\frac{\partial v_{1z}}{\partial \theta}\right)$$

$$\dot{\varepsilon}_{1rz} = \frac{1}{2}\left(\frac{\partial v_{1r}}{\partial z} + \frac{\partial v_{1z}}{\partial r}\right)$$

wherein $\dot{\varepsilon}_{1r}$, $\dot{\varepsilon}_{1\theta}$ and $\dot{\varepsilon}_{1z}$ are respectively strain velocity components of the difficult-to-deform metal slab in the diameter, the circumferential and the width directions; $\dot{\varepsilon}_{1r\theta}$ is a shear strain velocity component on circumferential and width sections of the difficult-to-deform metal slab, which points to the circumferential direction; $\dot{\varepsilon}_{1\theta z}$ is a shear strain velocity component on diameter and the width sections of the difficult-to-deform metal slab, which points to the width direction; $\dot{\varepsilon}_{1rz}$ is a shear strain velocity component on the circumferential and the width sections of the difficult-to-deform metal slab, which points to the width direction;

$$\frac{\partial v_{1r}}{\partial r}, \frac{\partial v_{1\theta}}{\partial r} \text{ and } \frac{\partial v_{1z}}{\partial r}$$

are partial derivatives of $v_{1r}$, $v_{1\theta}$ and $v_{1z}$ with respect to r;

$$\frac{\partial v_{1r}}{\partial \theta}, \frac{\partial v_{1\theta}}{\partial \theta} \text{ and } \frac{\partial v_{1z}}{\partial \theta}$$

are partial derivatives of $v_{1r}$, $v_{1\theta}$ and $v_{1z}$ with respect to θ;

$$\frac{\partial v_{1r}}{\partial z}, \frac{\partial v_{1\theta}}{\partial z} \text{ and } \frac{\partial v_{1z}}{\partial z}$$

are partial derivatives of $v_{1r}$, $v_{1\theta}$ and $v_{1z}$ with respect to z;

establishing the velocity field in the rolling deformation zone of the easy-to-deform metal slab as:

$$v_{2r} = -\frac{1}{r}\frac{\partial \phi_2}{\partial \theta}$$

$$v_{2\theta} = \frac{\partial \phi_2}{\partial r}$$

$$v_{2z} = 0$$

wherein $v_{2r}$, $v_{1\theta}$, $v_{2z}$ are respectively velocity components of the easy-to-deform metal slab in diameter, circumferential and width directions;

$$\phi_2 = v_0 h_{1i} b \frac{h_{2f} - A_2 \sin(B\omega t)}{h_{1f} + (A_2 - A_1)\sin(B\omega t)}\left[\frac{r - r_{3\theta}}{r_{2\theta} - r_{3\theta}} + \beta_2 \theta^2 (r - r_{2\theta})(r - r_{3\theta})\right]$$

is the flow function of the easy-to-deform metal slab, and an undetermined parameter $\beta_2$ is a constant which varies with the different rolling process parameters; the rolling process parameters comprise the metal types, the composite slab entrance thicknesses, the reductions, the entrance speeds, the roll speeds and the roll radii;

$$\frac{\partial \phi_2}{\partial \theta}, \frac{\partial \phi_2}{\partial r}$$

are partial derivatives of $\phi_2$ with respect to θ and r, respectively;

establishing the strain velocity field in the rolling deformation zone of the easy-to-deform metal slab as:

$$\dot{\varepsilon}_{2r} = \frac{\partial v_{2r}}{\partial r}$$

$$\dot{\varepsilon}_{2\theta} = \frac{1}{r}\frac{\partial v_{2\theta}}{\partial \theta} + \frac{v_{2r}}{r}$$

$$\dot{\varepsilon}_{2z} = \frac{\partial v_{2z}}{\partial z}$$

$$\dot{\varepsilon}_{2r\theta} = \frac{1}{2}\left(\frac{1}{r}\frac{\partial v_{2r}}{\partial \theta} + \frac{\partial v_{2\theta}}{\partial r} - \frac{v_{2\theta}}{r}\right)$$

$$\dot{\varepsilon}_{2\theta z} = \frac{1}{2}\left(\frac{\partial v_{2\theta}}{\partial z} + \frac{1}{r}\frac{\partial v_{2z}}{\partial \theta}\right)$$

$$\dot{\varepsilon}_{2rz} = \frac{1}{2}\left(\frac{\partial v_{2r}}{\partial z} + \frac{\partial v_{2z}}{\partial r}\right)$$

wherein $\dot{\varepsilon}_{2r}$, $\dot{\varepsilon}_{2\theta}$ and $\dot{\varepsilon}_{2z}$ are respectively strain velocity components of the easy-to-deform metal slab in the diameter, the circumferential and the width directions; $\dot{\varepsilon}_{2r\theta}$ is a shear strain velocity component on circumferential and width sections of the easy-to-deform metal slab, which points to the circumferential direction; $\dot{\varepsilon}_{2\theta z}$ is a shear strain velocity component on diameter and the width sections of the easy-to-deform metal slab, which points to the width direction; $\dot{\varepsilon}_{2rz}$ is a shear strain velocity component on the circumferential and the width sections of the easy-to-deform metal slab, which points to the width direction;

$$\frac{\partial v_{2r}}{\partial r}, \frac{\partial v_{2\theta}}{\partial r} \text{ and } \frac{\partial v_{2z}}{\partial r}$$

are partial derivatives of $v_{2r}$, $v_{2\theta}$ and $v_{2z}$ with respect to r;

$$\frac{\partial v_{2r}}{\partial \theta}, \frac{\partial v_{2\theta}}{\partial \theta} \text{ and } \frac{\partial v_{2z}}{\partial \theta}$$

are partial derivatives of $v_{2r}$, $v_{2\theta}$ and $v_{2z}$ with respect to θ;

$$\frac{\partial v_{2r}}{\partial z}, \frac{\partial v_{2\theta}}{\partial z} \text{ and } \frac{\partial v_{2z}}{\partial z}$$

are partial derivatives of $v_{2r}$, $v_{2\theta}$ and $v_{2z}$ with respect to z.

5. The method, as recited in claim 1, wherein in the step 4.4, the total power functional J* at any time t of the slab corrugated rolling is calculated as:

$$J^* = \sqrt{\frac{2}{3}}\sigma_{s1} b \int_0^{\alpha_1}\int_{r_{1\theta}}^{r_{3\theta}} \sqrt{\dot{\varepsilon}_{1r}^2 + \dot{\varepsilon}_{1\theta}^2 + \dot{\varepsilon}_{1z}^2 + 2\dot{\varepsilon}_{1r\theta}^2 + 2\dot{\varepsilon}_{1\theta z}^2 + 2\dot{\varepsilon}_{1rz}^2}\, r dr d\theta +$$

-continued $$\sqrt{\frac{2}{3}}\sigma_{s2}b\int_0^{\alpha_2}\int_{r_{3\theta}}^{r_{2\theta}}\sqrt{\varepsilon_{2r}^2+\varepsilon_{2\theta}^2+\varepsilon_{2z}^2+2\varepsilon_{2r\theta}^2+2\varepsilon_{2\theta z}^2+2\varepsilon_{2rz}^2}\,rdrd\theta+$$

$$\frac{\sigma_{s1}b}{\sqrt{3}}\int_{r_{1\theta}}^{r_{3\theta}|_{\theta=\alpha_1}}\sqrt{(v_{1\theta}|_{\theta=\alpha_1})^2+(v_{1r}|_{\theta=\alpha_1})^2}\,rdr+$$

$$\frac{\sigma_{s2}b}{\sqrt{3}}\int_{r_{3\theta}|_{\theta=\alpha_2}}^{r_{2\theta}}\sqrt{(v_{2\theta}|_{\theta=\alpha_2})^2+(v_{2r}|_{\theta=\alpha_2})^2}\,rdr+$$

$$\frac{m_1\sigma_{s1}b}{\sqrt{3}}\int_0^{\alpha_1}\sqrt{(v_{1\theta}|_{r=r_{1\theta}}-r_{1\theta}\omega)^2}\,r_{1\theta}d\theta+$$

$$\frac{m_2\sigma_{s2}b}{\sqrt{3}}\int_0^{\alpha_2}\sqrt{(v_{2\theta}|_{r=r_{2\theta}}-R_0\omega)^2}\,r_{2\theta}d\theta$$

wherein $\sigma_{s1}$ and $\sigma_{s2}$ are the deformation resistances of the difficult-to-deform metal slab and the easy-to-deform metal slab, $$\alpha_1=\arcsin\left(\frac{l}{R_0}\right)$$

is an angle between MO and a roll center line $OO_2$, M is a contact point between the difficult-to-deform metal slab and the corrugating roll, $$\alpha_2=\arctan\left(\frac{2l}{2R_0+h_{1i}+h_{2i}+h_{1f}+h_{2f}}\right)$$

is an angle between NO and the roll center line $OO_2$, N is a contact point between the easy-to-deform metal slab and the flat roll.

6. The method, as recited in claim 1, wherein the step 4.5 comprises specific steps of: calculating the minimum value $J_{min}^*$ of the total power functional at any time t, and calculating the rolling force F at any time t according to the relationship $$F=\frac{J_{min}^*}{2\omega\chi\sqrt{2R_0(h_{1i}+h_{2i}-h_{1f}-h_{2f})}}$$

between the total power functional and the rolling force, wherein $\chi$ is a force arm coefficient.

7. The method, as recited in claim 1, wherein in the step 5, the roll gap S is calculated as:

$$S=h_{1f}+h_{2f}-\frac{F}{M}$$

wherein M is a stiffness of the rolling mill.

* * * * *